US010132139B1

(12) United States Patent
Roberts et al.

(10) Patent No.: US 10,132,139 B1
(45) Date of Patent: Nov. 20, 2018

(54) MID-STRING WIPER PLUG AND CARRIER

(71) Applicant: GRYPHON OILFIELD SOLUTIONS, LLC, Houston, TX (US)

(72) Inventors: Tyler Roberts, Houston, TX (US); Ian Beckett, Houston, TX (US); Geoff Williams, Houston, TX (US); Mark Haire, Houston, TX (US); Gerardo Franco, Houston, TX (US)

(73) Assignee: Gryphon Oilfield Solutions, LLC, Houston, TX (US)

( * ) Notice: Subject to any disclaimer, the term of this patent is extended or adjusted under 35 U.S.C. 154(b) by 0 days.

(21) Appl. No.: 16/058,168

(22) Filed: Aug. 8, 2018

Related U.S. Application Data

(60) Provisional application No. 62/572,117, filed on Oct. 13, 2017.

(51) Int. Cl.
*E21B 37/04* (2006.01)
*E21B 33/14* (2006.01)

(52) U.S. Cl.
CPC ..... *E21B 37/04* (2013.01); *E21B 33/14* (2013.01)

(58) Field of Classification Search
None
See application file for complete search history.

(56) References Cited

U.S. PATENT DOCUMENTS 3,070,169 A * 12/1962 Spain ..... E21B 37/04 15/104.061
3,076,509 A 2/1963 Burns et al.
3,185,218 A * 5/1965 Hoch ..... E21B 33/14 166/154
3,364,996 A * 1/1968 Brown ..... E21B 33/05 166/120
4,436,151 A * 3/1984 Callihan ..... E21B 33/16 166/154
4,819,726 A * 4/1989 Beirute ..... E21B 33/16 166/156
5,709,269 A 1/1998 Head
7,322,417 B2 1/2008 Rytlewski et al.
8,276,670 B2 10/2012 Patel
9,016,388 B2 4/2015 Kellner et al.
9,518,440 B2 12/2016 Sanchez et al.
2007/0181224 A1 8/2007 Marya et al.
2012/0138297 A1 * 6/2012 Johnson ..... E21B 33/14 166/285

(Continued)

*Primary Examiner* — Shane Bomar
(74) *Attorney, Agent, or Firm* — Winston & Strawn LLP

(57) ABSTRACT

A wiper plug that includes an elongated body member having a forward end, a rearward end, and an open central bore; spaced radially outwardly projecting wiping flanges made of flexible material and configured to extend beyond the inner diameter of the pipe to be cleaned but that deform to apply contact wiping pressure to the inner diameter of the pipe as the wiper plug travels through the pipe; and shearing elements that extend from the rearward end of the elongated body member by a distance that is greater than the inner diameter of the pipe to be cleaned. The shearing elements hold the wiper plug in position in between two connected pipe sections while the open central bore allows cement to flow therethrough. Also, a carrier pipe for the wiper plug and method of use thereof for cleaning cement from the wellbore annulus of long casing strings.

16 Claims, 2 Drawing Sheets

(56) References Cited

U.S. PATENT DOCUMENTS

| | | | | |
|---|---|---|---|---|
| 2014/0034310 | A1* | 2/2014 | Andersen | E21B 34/14<br>166/281 |
| 2014/0102723 | A1* | 4/2014 | Stair | E21B 23/08<br>166/386 |

* cited by examiner

MID-STRING WIPER PLUG AND CARRIER

This application claims the benefit of provisional application 62/572,117 filed Oct. 13, 2017, the entire content of which is expressly incorporated herein by reference thereto.

BACKGROUND

The invention relates to wiper plugs for cleaning of residual cement from inside tubular strings, carriers for such wiper plugs and a method for use of the wiper plugs to clean long sections of pipe wherein the wiper plugs and carriers are arranged in the pipe at different locations so that new wiper plugs can be deployed to clean remote sections of the pipe.

In the oil and gas industry, when a well is drilled a casing is put into the well and it needs to be secured by cementing the casing to the wellbore. The cement is introduced through the inner diameter of the pipe and after the cementing process is completed, the inner diameter of the pipe must be cleaned to remove any remaining cement therefrom.

Wiper plugs are thus used to displace cement from a tubular string that has just had cement pumped through its lower end and into a surrounding annular space to seal it. Typically, a cement shoe keeps the pumped cement from coming back from the annulus into the string through which it was delivered. Some systems deliver a wiper plug as a spacer before the cement is delivered and introduce another wiper to go behind the cement, but the second wiper is the one that does the work in wiping the cement from the annulus of the pipe string.

Wiper plugs generally comprise of a series of cone shaped structures parallel to each other generally made of a resilient material. They are held above a wellhead in an enclosure called a lubricator which in essence is a long tubular with valves near opposed ends. The lubricator allows the well to be isolated to load the wiper plug or plugs and then the loading valve to be closed and the drop valve to be opened to release the wiper plug into the wellbore string. The string generally has a sub for catching the wiper plug called a landing collar.

The wiping plug that is introduced into the pipe is pressurized to travel from the surface down to the toe wherein it cleans and pushes any residual cement to the toe valves. It is important that the cleaning process be sufficient to remove the residual cement so that it does not plug the toe valve during operation of the well.

Deploying wiper plugs into the wellbore to clean residual cement has been used for years and is very effective at cleaning up to depths of about 5,000 feet. After that distance, the wiper plug loses effectiveness as the rubber or elastomeric wiping flanges exhibit wear due to abrasion. The flanges actually become torn up due to the distance traveled and the amount of cement to be removed from the interior of the pipe strings. The use of longer or multiple wiper plugs can provide better cleaning action but the cleaning effectiveness of those plugs also becomes reduced when greater lengths of pipe strings need to be cleaned.

The present invention now provides a solution to this problem by providing wiper plugs that significantly enhance the effectiveness of cleaning of interior pipe strings over distances over 10,000 to as long as 25,000 feet or more.

SUMMARY OF THE INVENTION

The present invention relates to a wiper plug that includes an elongated body member having a forward end, a rearward end, and an open central bore; spaced radially outwardly projecting wiping flanges made of flexible material and configured to extend beyond the inner diameter of the pipe to be cleaned but that deform to apply contact wiping pressure to the inner diameter of the pipe as the wiper plug travels through the pipe; and shearing elements that extend from the rearward end of the elongated body member by a distance that is greater than the inner diameter of the pipe to be cleaned. The shearing elements are configured and dimensioned to hold the wiper plug in position in between two connected pipe sections while the open central bore allows cement or other fluids or slurries to flow therethrough. Also, the rearward end of the plug has an opening that is larger in diameter than that of the central bore of the body member, and the forward end of the plug has an outer diameter that is smaller than the diameter of the opening in the rearward end of the plug.

Advantageously, the opening at the rearward end of the plug includes internal threads. This is particularly useful for the last wiper plug to be introduced wherein that wiper plug further comprises a tail plug that is threadedly received in the opening at the rearward end of the previously introduced wiper plug. The tail plug is configured and dimensioned to close off the open bore of the body member of the last wiper plug so that the last wiper plug can be forced to travel through the pipe interior until it contacts the previously introduced wiper plug.

Preferably, the previously introduced and held wiper plugs have shearing elements in the form of shearing pins wherein 3 to 6 shearing pins are provided in spaced relation about the circumference of the rearward end of the wiper plugs. These pins are fastened by screwing, welding, brazing, by an adhesive or by other joining operations.

To deploy the wiper plugs at different locations in the pipe string, a wiper plug carrier is provided. This carrier comprises a wiper plug that has shearing elements as described herein and a pipe section for carrying the wiper plug into the pipe string. The pipe section has an inner diameter that is smaller than the distance that the shearing elements extend from the wiper plug, and is provided with an open end that includes a channel that is configured for receiving the shearing elements therein so that the rearward end of the wiper plug cannot pass through the pipe section. Typically the channel is provided at the rearward end of the pipe section and the wiper plug is provided in that end. As noted, the wiper plug is not able to pass through the pipe section so that it can be delivered to a remote location of the well. The wiper plug is thus secured and help in a remote location in the casing string, typically by end connections on the carrier pipe section that join that section to other pipe sections.

The invention also relates to a method of improving effectiveness of cement cleaning from a wellbore annulus of a casing string. The method includes providing wiper plug carriers as disclosed herein at different spaced locations in the casing string wherein the wiper plugs of the carriers are held at that location until cement introduction into the wellbore annulus is complete; introducing a closed end wiper plug into the wellbore annulus and through the casing string from the wellhead to clean residual cement from the wellbore annulus nearest the wellhead; deploying the closed end wiper plug into contact with a wiper plug held in a first carrier; and increasing pressure on the closed end wiper plug to overcome resistance from the shearing elements and free the wiper plug in the first carrier to clean cement from a further subjacent portion of the wellbore annulus of the casing string past the first carrier. The wiper plug of the first carrier are able to provide more effective cleaning of cement from the wellbore annulus because it was not used for wiping cement until after being freed for movement.

The closed end wiper plug is typically configured and dimensioned to be the same as the wiper plug in the carrier but without the shearing elements and with a tail plug instead. The tail plug is configured and dimensioned to close off the open bore of the body member of the closed end wiper plug to allow it to be moved by pressure thereon. Preferably, the closed end plug includes an opening at its rearward end with the opening including internal threads, and the tail plug is threadedly received in the opening.

The method includes positioning the wiper plug carrier at about 5,000 feet to 10,000 feet from the surface. When multiple carriers are used, subsequent carriers are positioned about 5,000 feet to 10,000 feet apart. For that embodiment, the method includes deploying the closed end wiper plug and wiper plug held in a first carrier through the subjacent portion of the wellbore annulus of the casing string until it contacts the wiper plug of a subjacent carrier; and increasing pressure on the closed end wiper plug to overcome resistance from the shearing elements of the wiper plug of the subjacent carrier and free the wiper plug from that carrier to clean cement from a further subjacent portion of the wellbore annulus of the casing string past the subjacent carrier. Again, each wiper plug of a subjacent carrier provides more effective cleaning of cement from the wellbore annulus because it was not used for wiping cement until after being freed for movement.

The method is intended to be applied to long piping strings, wherein each carrier and associated plug is spaced at least about 10,000 feet from the wellhead and each other so that pipe strings can be effectively cleaned of cement over distances over at least 25,000 feet or more. Also, the pressure on the closed end wiper plug is typically increased to about 10,000 PSI to overcome resistance from the shearing elements and free the wiper plug from the first carrier.

BRIEF DESCRIPTION OF THE DRAWINGS

These and other aspects of the present invention will be more readily apparent to those skilled in the art from a review of the description of the preferred embodiment which appears below with the associated drawings, wherein.

DETAILED DESCRIPTION

Figure 1:
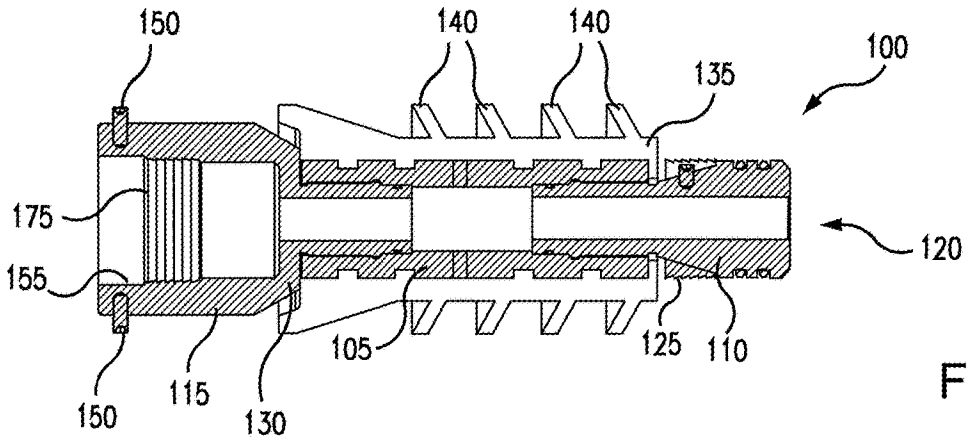
FIG. 1 is a side cross-sectional view of a wiper plug according to the present invention.
Figure 2:
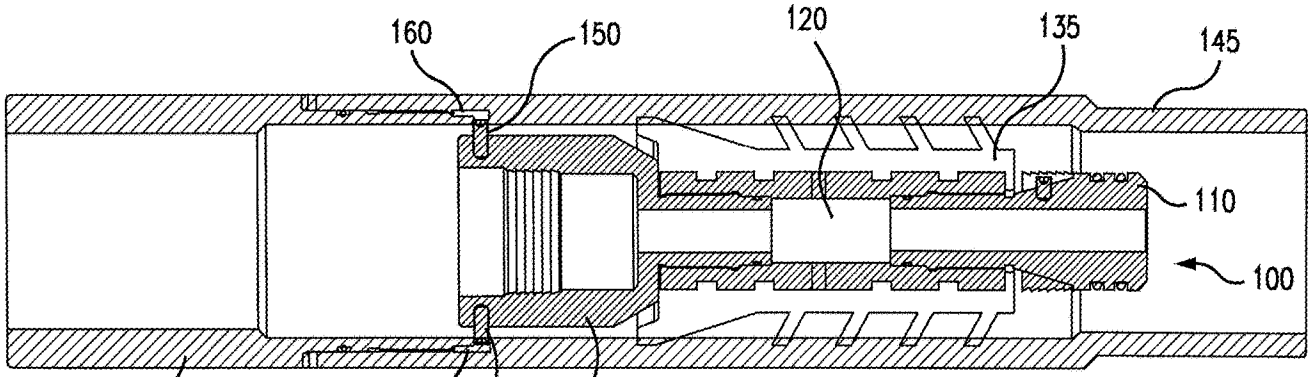
FIG. 2 is a side cross-sectional view of a carrier and wiper plug combination.

The wiper plug of the present invention is best shown in FIGS. 1 and 2. The wiper plug 100 includes an elongated body member 105 having a forward end 110, a rearward end 115, and an open central bore 120. The central bore allows liquid or slurries to pass therethrough when the plug is fixed in position in the pipe string.

The forward 110 and rearward 115 ends of the body member 105 are typically separate components that are press fit into the body member 105 using a suitable gasket or shoulder. The forward end 110 is configured with a larger base flange 125 so that it cannot enter into the body member 105. The same is true of the rearward end 115 which includes a wide flanged base 130 that prevents the rearward end 115 from entering into body member 105. Thus, pressure against the rearward end 115 is directed to the body member 105 which is turn is transferred to the forward end 110. As the wiper plug 100 moves downwardly into the wellbore it remain as an integral until without experiencing separation of the joined components.

The body member 105 also includes a wiping member 135 which includes a plurality of spaced radially outwardly projecting wiping flanges 140. The wiping member and wiping flanges are typically made of flexible material such as rubber or an elastomer which is configured to extend beyond the inner diameter of the pipe 145 to be cleaned but that are sufficiently resilient to deform to apply contact wiping pressure to the inner diameter of the pipe 145 as the wiper plug travels therethrough.

Shearing elements 150 are provided that extend from the rearward end 115 of the elongated body member 105 by a distance that is greater than the inner diameter of the pipe 145 to be cleaned. The shearing elements 150 are configured and dimensioned to hold the wiper plug in position in between two connected pipe sections while the open central bore 120 allows cement or other fluids or slurries to flow through the wiper plug. This allows the plug 100 to remain in position in the pipe during the operation of introducing cement for securing the casing in place in the hole.

The shearing elements of the wiper plug are typically three or four shearing pins that are spaced about the circumference of the rearward end of the plug. These pins are designed to be sheared at a pressure of less than about 2,500 PSI and preferably in the range of about 400 to about 2000 PSI. The preferred pressure would be less than about 1000 PSI. The pins can be secured to the rearward end of the wiper plug by being screwed into an appropriate threaded aperture, by welding or brazing when the plug body is a metal or by the use of an aperture and adhesive. Instead of pins, other fastening elements can be used, such as a flange member, hooks or protrusions provided on the outer surface of the rearward end of the body member. Typically, the pins are made of a metal such as aluminum so that they do not provide as much strength as the steel body member and can be more easily sheared. It is also possible to provide notches or other areas of weakness in the shearing elements to allow them to be overcome at a particular pressure or force. Of course, a skilled artisan can configure the shearing pins to be fractured or sheared at an appropriate force or pressure for proper operation of the invention. All of this can be determined by routine experimentation to determine optimum arrangements. The lower PSI values are preferred because they avoid or prevent water hammer issues during operation.

Also, the rearward end 115 of the plug has an opening 155 that is larger in diameter than that of the central bore 120 of the body member 105, and the forward end 110 of the plug has an outer diameter that is smaller than the diameter of the opening in the rearward end of the plug. Thus, after being freed from its help position, the wiper plug 100 can then move through the subjacent pipe string for cleaning until it reaches the next subjacent carrier and wiping plug combination. At that point, the forward end 110 of the wiper plug 100 can be received in the open rearward end 115 of the subjacent plug to initially stop the forward movement of plug 100.

As shown in FIG. 2, the wiper plug 100 of the present invention is preinstalled on a section of casing 145 that is introduced into the wellbore during installation. The casing includes a cylindrical slot 160 that has an outer dimension that is greater than the distance that the shearing elements 150 extend from the wiper plug 100. Thus, when a further pipe section 165 casing is attached to pipe section 145 in the casing string, the wiper plug 100 is maintained in position by being held between carrier pipe section 145 and follower pipe 165 by virtue of the shearing elements 150 located in slot 155. The carriers can be introduced at various distances of for example every 5000 to 10,000 feet to assure that a new wiper plug would be available for cleaning each length of subjacent pipe casing between the held plug and a subjacent carrier/plug combination.

Figure 3:
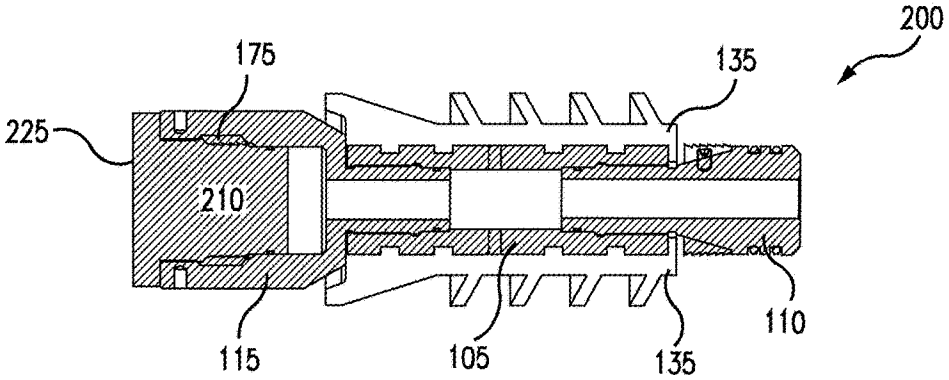
FIG. 3 is a side-cross-sectional view of a closed end wiper plug that is introduced into the top of the well.

As shown in FIG. 3, after the carrier/wiping plug combinations are installed in the casing string, an initial wiper plug will be introduced into the casing at the wellhead. In order to be deployed, the initial wiper plug must either be solid or have a closed end. While a conventional solid plug can be utilized, the initial wiper plug will be the one shown in FIG. 3. This wiper plug 200 has a forward end that fits within the open rearward end 110 of the wiper plugs 100 of the present invention. While this is not necessary, it is preferred to enable wiper plug 200 and wiper plug 100 to travel together through the wellbore after wiper plug 100 is freed from its shearing elements 150. Another option for wiper plug 200 is to instead use a solid end so that it can move through the wellbore and push other plugs further down the wellbore.

A preferred arrangement for wiper plug 200 is the use of the same construction as wiper plug 100 with two small changes. A first change is that the shearing elements are not provided so that the wiper plug 200 can move through the wellbore annulus when sufficient force or pressure is provided behind it. Another preferred wiper plug 200 is that disclosed in provisional application 62/593,587 filed Dec. 1, 2017 which is expressly incorporated herein by reference thereto. The wiper plug of that application is similar to the one shown in current FIG. 3 except that it includes a rupture disk or diaphragm that closes off the central bore and that is configured to withstand an amount of pressure and rupture when the pressure exerting on the rupture disk exceeds a threshold pressure. By the way, a skilled artisan is well aware of how much pressure is needed to be applied to move the plugs as it is done in a similar manner to existing wiper plug deployment.

A second change is that the opening 155 of the rearward end 115 is provided with threads 175. This allows the opening 155 to be closed off by the addition of a tail plug 210 which has mating threads to those 175 of opening 155. The tail plug has a solid construction or is in the form of a cap that has a rear surface 225 that receives a pressurized slurry or liquid, such as water, to move plug 200 through the casing string. The solid or closed end allows pressure to build up behind the plug to move it through the casing to encounter the fixed plugs that are positioned downstream in the casing string. The other components of wiper plug 200 that are the same as in wiper plug 100 are identified by the same element number and a further description is not repeated here.

Figure 4:
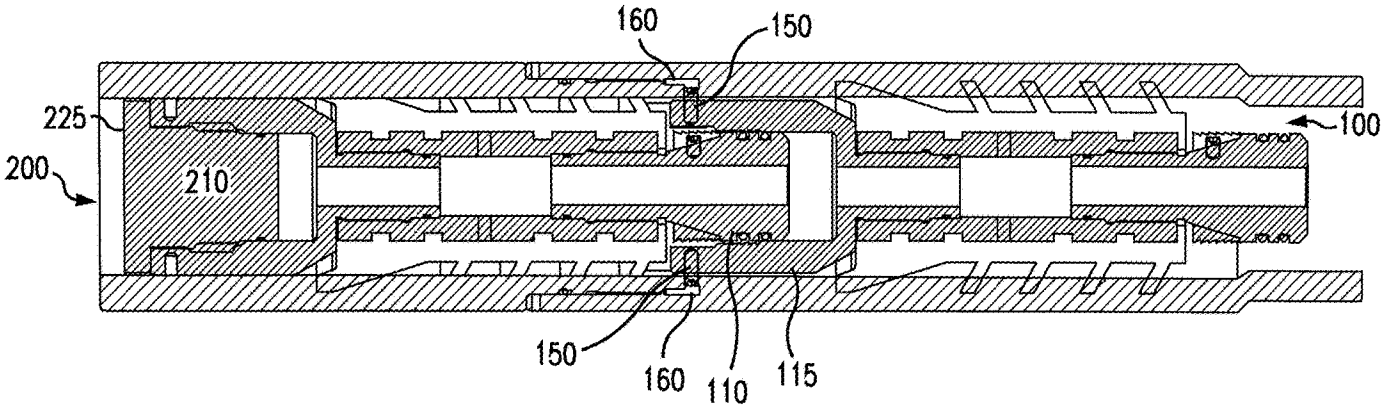
FIG. 4 is an illustration of the wiper plug of FIG. 3 in operative association and contact with the wiper plug of FIG. 2.

The initial wiping plug 200 will be launched from the surface and it will wipe the pipe interior surface until it latches onto the first of the fixed carrier/plug combinations. This is shown in FIG. 4 wherein wiper plug 200 is in contact with wiper plug 100 with forward end 110 of wiper plug 200 in the opening 155 in the rearward end 110 of wiper plug 100. An increase in pressure will be measured at the wellhead at the surface to indicate that the deployed plug has encountered and latched to the first fixed position plug wherein the shearing elements are retaining wiper plug 100 in position in pipe 145. At that point the plugs are mechanically locked as a single unit to proceed further. In one embodiment, the forward end is configured with threads so that it can screw into the open rearward end of the stationary wiper plug. Alternatively, the forward end can be configured to be press fit into the open rearward end. The press fit embodiment is preferred.

When a pressure increase is measured at the surface, the operator becomes aware of the engagement of the two plugs. This enables the operator to increase the pressure to a sufficient level so that the resistance provided by the shearing plugs is overcome. This typically results in breakage of the shearing elements which are then carried through the pipe string between the connected plugs. After the resistance from the shearing elements is overcome, the pressure can be reduced appropriately to move the joined plugs through the pipe casing. As noted, the freed plug is new and provides optimum wiping action on the subsequent length of piping until the next fixed plug and carrier are encountered.

Depending upon the length of the wellbore, additional plugs can be staged inside the casing string so that the process can be repeated for wiping of the internal piping services by the next fixed plug. At the end of the wiping procedure, the first deployed plug and all further deployed previously fixed plugs will latch into the landing collar as a single length of j oined plugs.

As noted in the background, for long casing strings, it is difficult to clean the wellbore annulus because the wiper plugs wear when traveling over such long distances. Even the use of multiple plugs is problematic because as the first plug begins to wear it leaves cement residues that cause wear on the additional plugs which also must travel the same long distances in contact with the pipe bore. In contrast, the present invention provides wiping plug carriers that deliver an unused wiper plug to different distances along and within the pipe string so that a brand new wiper plug can be deployed at those distances and further into the pipe string. In particular, a first wiper plug is deployed from the surface and it moves through the pipe until it reaches the first carrier/wiper plug assembly. The forward end of the wiper plug fits into the opening of the held wiper plug in the carrier. As the pressure builds up behind the first deployed wiper plug, it reaches a level where the first deployed plug shears the shearing elements of the wiper plug that is held in the carrier to then deploy that wiper plug for cleaning. The freed wiper plug travels with the first deployed plug as a combination through the next distance of pipe string until a further carrier/wiper plug combination is encountered. At that further distance, the forward movement of the combination is prevented due to contact with the wiper plug that is held in the carrier, again with the forward end of the first freed wiper plug engaging the rearward end of the held wiper plug. The pressure is again increased until the shearing elements are sheared and now a combination of three plugs can move through the next further distance of the pipe string for cleaning of that portion of the string. This is continued for each subsequent combination. The result is that each length of pipe being between the plug/carrier assemblies is wiped with a new wiper plug so that the best cleaning action can be obtained regardless of where the pipe is located in its distance from the surface.

Therefore, in sum, it is to be realized that the optimum dimensional relationships for the parts of the invention can include variations and tolerances in size, materials, shape, form, function and use are deemed readily apparent and obvious to the skilled artisan, and all equivalent relationships to those illustrated in the drawings and described in the specification are intended to be encompassed by the claims appended hereto.

Unless defined otherwise, all technical and scientific terms used herein have same meaning as commonly understood by one of ordinary skill in the art to which this invention belongs. Also, as used herein and in the appended claims, the singular form "a", "and", and "the" include plural referents unless the context clearly dictates otherwise. All technical and scientific terms used herein have the same meaning.

The foregoing detailed description is considered as illustrative only of the principles of the invention. Further, since numerous modifications and changes will readily be apparent to those having ordinary skill in the art, it is not desired to limit the invention to the exact constructions demonstrated. Accordingly, all suitable modifications and equivalents may be resorted to falling within the scope of the invention.

What is claimed is:

1. A wiper plug comprising:

an elongated body member having a forward end, a rearward end, and an open central bore;

spaced radially outwardly projecting wiping flanges made of flexible material and configured to extend beyond the inner diameter of the pipe to be cleaned but to deform to apply contact wiping pressure to the inner diameter of the pipe as the wiper plug travels through the pipe; and shearing elements that extend from the rearward end of the elongated body member by a distance that is greater than the inner diameter of the pipe to be cleaned;

wherein the shearing elements are configured and dimensioned to hold the wiper plug in position in between two connected pipe sections while the open central bore allows cement or other fluids or slurries to flow therethrough; and wherein the rearward end of the plug has an opening that is larger in diameter than that of the central bore of the body member, and the forward end of the plug has an outer diameter that is smaller than the diameter of the opening in the rearward end of the plug.

2. The wiper plug of claim 1, wherein the opening at the rearward end of the plug includes internal threads.

3. The wiper plug of claim 2, further comprising a tail plug that is threadedly received in the opening at the rearward end and that is configured and dimensioned to close off the open bore of the body member.

4. The wiper plug of claim 1, wherein the shearing elements are shearing pins and wherein 3 to 6 shearing pins are provided in spaced relation about the circumference of the rearward end.

5. A wiper plug carrier comprising the wiper plug of claim 1 and a pipe section, wherein the pipe section has an inner diameter that is smaller than the distance that the shearing elements extend from the wiper plug, and an open end that includes a channel that is configured for receiving the shearing elements therein so that the rearward end of the wiper plug cannot pass through the pipe section.

6. The wiper plug carrier of claim 5, wherein the pipe section includes end connections for joining to other pipe sections in the casing string.

7. A method of improving effectiveness of cement cleaning from a wellbore annulus of a casing string which comprises:

providing wiper plug carriers according to claim 5 at different spaced locations in the casing string wherein the wiper plugs of the carriers are held at that location until cement introduction into the wellbore annulus is complete;

introducing a closed end wiper plug into the wellbore annulus and through the casing string from the wellhead to clean residual cement from the wellbore annulus nearest the wellhead;

deploying the closed end wiper plug into contact with a wiper plug held in a first carrier; and increasing pressure on the closed end wiper plug to overcome resistance from the shearing elements and free the wiper plug in the first carrier to clean cement from a further subjacent portion of the wellbore annulus of the casing string past the first carrier;

wherein the wiper plug of the first carrier provides more effective cleaning of cement from the wellbore annulus because it was not used for wiping cement until after being freed for movement.

8. The method according to claim 7 wherein the closed end wiper plug is configured and dimensioned to be the same as the wiper plug in the carrier but without the shearing elements and with a tail plug instead, wherein the tail plug is configured and dimensioned to close off the open bore of the body member of the closed end wiper plug.

9. The method according to claim 8, wherein the closed end plug includes an opening at its rearward end with the opening including internal threads, and the tail plug is threadedly received in the opening.

10. The method according to claim 7 wherein the wiper plug carrier is positioned about 5,000 feet to 10,000 feet from the surface.

11. The method according to claim 7 wherein multiple wiper plug carriers are spaced at various distances in the casing string, with each carrier being spaced about 5000 feet to 10,000 feet from an adjacent carrier.

12. The method according to claim 11 which further comprises:

deploying the closed end wiper plug and wiper plug held in a first carrier through the subjacent portion of the wellbore annulus of the casing string until it contacts the wiper plug of a subjacent carrier; and increasing pressure on the closed end wiper plug to overcome resistance from the shearing elements of the wiper plug of the subjacent carrier and free the wiper plug from that carrier to clean cement from a further subjacent portion of the wellbore annulus of the casing string past the subjacent carrier;

wherein the wiper plug of the subjacent carrier provides more effective cleaning of cement from the wellbore annulus because it was not used for wiping cement until after being freed for movement.

13. The method of claim 12 wherein the deploying and increasing pressure steps are repeated for each subjacent carrier.

14. The method of claim 12 wherein each carrier is spaced at least about 10,000 feet from the wellhead and each other so that pipe strings can be effectively cleaned of cement over a distance of at least 25,000 feet.

15. The method of claim 7 wherein the pressure on the closed end wiper plug is increased to overcome resistance from the shearing elements and free the wiper plug from the first carrier.

16. The method of claim 15 wherein the pressure on the closed end wiper plug is between about 400 and 2000 PSI.

* * * * *